US009643432B2

(12) United States Patent
Kanada et al.

(10) Patent No.: US 9,643,432 B2
(45) Date of Patent: May 9, 2017

(54) LIQUID EJECTING APPARATUS AND LIQUID EJECTING METHOD

(71) Applicant: Seiko Epson Corporation, Tokyo (JP)

(72) Inventors: Hidemasa Kanada, Matsumoto (JP); Kenichi Tanioka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/880,983

(22) Filed: Oct. 12, 2015

(65) Prior Publication Data

US 2016/0101636 A1 Apr. 14, 2016

(30) Foreign Application Priority Data

Oct. 14, 2014 (JP) ..... 2014-209990

(51) Int. Cl.
*B41J 11/66* (2006.01)
*B41J 11/70* (2006.01)

(52) U.S. Cl.
CPC ..... *B41J 11/663* (2013.01); *B41J 11/70* (2013.01)

(58) Field of Classification Search
CPC . B41J 11/663; B41J 11/66; B41J 11/70; B41J 11/68
See application file for complete search history.

(56) References Cited

U.S. PATENT DOCUMENTS 5,829,897 A * 11/1998 Murai ..... B41J 2/36 400/582
6,382,850 B1 * 5/2002 Freund ..... B41J 3/60 347/102
6,923,534 B2 * 8/2005 Sai ..... B26D 7/088 101/416.1
2005/0024464 A1 * 2/2005 Takagi ..... B41J 11/007 347/104
2005/0270352 A1 * 12/2005 Iwase ..... B41J 11/663 347/104
2012/0148326 A1 * 6/2012 Ipponyari ..... B26D 1/045 400/621
2012/0299991 A1 * 11/2012 Wakita ..... B41J 11/663 347/16
2013/0271545 A1 * 10/2013 Nagashima ..... B41J 11/70 347/104

FOREIGN PATENT DOCUMENTS

JP 2001-097635 A 4/2001
JP 2003-300195 A 10/2003
JP 2005-089053 A 4/2005
JP 2006-341433 A 12/2006
JP 2007-181975 A 7/2007

* cited by examiner

*Primary Examiner* — Stephen Meier
*Assistant Examiner* — John P Zimmerman
(74) *Attorney, Agent, or Firm* — Workman Nydegger

(57) ABSTRACT

A liquid ejecting apparatus includes a transporting unit which can transport a medium along a first direction; an ejecting unit which can eject liquid; a cutting unit which is provided on a downstream side in the first direction compared to the ejecting unit, and can cut the medium; and a control unit which can execute an ejecting operation in which the liquid is ejected onto the medium using the ejecting unit, and a cutting operation in which the medium is cut using the cutting unit, in which the control unit executes a post-cutting transport operation in which the medium is transported using the transporting unit between executing of the cutting operation and executing of the ejecting operation.

18 Claims, 13 Drawing Sheets

LIQUID EJECTING APPARATUS AND LIQUID EJECTING METHOD

BACKGROUND

1. Technical Field

The present invention relates to a liquid ejecting apparatus and a liquid ejecting method.

2. Related Art

In the related art, a liquid ejecting apparatus which includes a cutting unit which can cut a medium has been used. In such a liquid ejecting apparatus, there has been a case in which the medium is moved when cutting the medium using the cutting unit, and a landing position of liquid has been deviated.

Therefore, in JP-A-2003-300195, an ink jet recording apparatus as a liquid ejecting apparatus which can suppress a movement of a medium when cutting the medium using the cutting unit is disclosed.

The ink jet recording apparatus in JP-A-2003-300195 has a configuration in which a movement of a medium is suppressed by limiting the movement speed of a cutter as a cutting unit. For this reason, since it is possible to suppress the movement of the medium when cutting the medium using the cutter, deviation of a landing position of liquid can be suppressed. However, since a case in which the time which is necessary for cutting a medium is desired to be suppressed by limiting the movement speed of a cutter is taken into consideration, a case is also taken into consideration in which another method for suppressing a landing failure of liquid which is associated with cutting of a medium is desired.

SUMMARY

An advantage of some aspects of the invention is to suppress a landing failure of liquid which is associated with cutting of a medium.

According to an aspect of the invention, there is provided a liquid ejecting apparatus which includes a transporting unit which can transport a medium along a first direction; an ejecting unit which can eject liquid; a cutting unit which is provided on a downstream side in the first direction compared to the ejecting unit, and can cut the medium; and a control unit which can execute an ejecting operation in which the liquid is ejected onto the medium using the ejecting unit, and a cutting operation in which the medium is cut using the cutting unit, in which the control unit executes a post-cutting transport operation in which the medium is transported using the transporting unit between executing of the cutting operation and executing of the ejecting operation.

In the liquid ejecting apparatus, the control unit may execute a transport operation after ejecting in which the medium is transported by the length of a first distance using the transporting unit after the ejecting operation, and a transport distance of the medium in the post-cutting transport operation may be set to be shorter than the first distance.

In the liquid ejecting apparatus, the control unit may execute a pre-cutting transport operation in which the medium is transported using the transporting unit before executing the cutting operation, may set a transport distance in the pre-cutting transport operation to a second distance which is shorter than the first distance when a position of the medium to be cut matches a cutting position using the cutting unit, if a transport distance of the medium in the pre-cutting transport operation is the first distance, and may transport the medium by a distance that is the difference between the first distance and the second distance in the post-cutting transport operation.

In the liquid ejecting apparatus, the control unit may execute the pre-cutting transport operation in which the medium is transported using the transporting unit before executing the cutting operation, may set the transport distance in the pre-cutting transport operation to a third distance which is shorter than the first distance when the position of the medium to be cut does not match the cutting position using the cutting unit, if the transport distance of the medium in the pre-cutting transport operation is the first distance, and may transport the medium by a distance that is the difference between the first distance and the third distance in the post-cutting transport operation.

In the liquid ejecting apparatus, the transport distance of the medium in the post-cutting transport operation may be set to be equal to or greater than 0.1 mm and equal to or smaller than 0.5 mm.

In the liquid ejecting apparatus, the control unit may transport the medium in the first direction in the post-cutting transport operation.

In the liquid ejecting apparatus, the control unit may transport the medium in a second direction which is a direction opposite to the first direction in the post-cutting transport operation.

In the liquid ejecting apparatus, the transport distance of the medium in the post-cutting transport operation may be changed based on a length of the medium in a width direction which is a direction intersecting the first direction.

In the liquid ejecting apparatus, the control unit may set a transport distance of the medium in the post-cutting transport operation in a case in which the length of the medium in the width direction is a first length to be longer than a transport distance of the medium in the post-cutting transport operation in a case in which the length of the medium in the width direction is a second length which is longer than the first length.

In the liquid ejecting apparatus, the control unit may execute a transport operation after ejecting in which the medium is transported by the first distance using the transporting unit after the ejecting operation, and the pre-cutting transport operation in which the medium is transported using the transporting unit before executing the cutting operation, and may execute the ejecting operation between the pre-cutting transport operation and the cutting operation, when a transport distance of the medium in the pre-cutting transport operation is the first distance.

According to another aspect of the invention, there is provided a liquid ejecting method which can be executed using a liquid ejecting apparatus which includes a transporting unit which can transport a medium in a first direction; an ejecting unit which can eject liquid; and a cutting unit which is provided on a downstream side in the first direction compared to the ejecting unit, and can cut the medium, the method including executing a post-cutting transport operation in which the medium is transported using the transporting unit between executing of the cutting operation in which the medium is cut using the cutting unit and executing of the ejecting operation in which the liquid is ejected onto the medium using the ejecting unit.

According to the aspects of the invention, it is possible to suppress a landing failure of liquid which is associated with cutting of a medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus 1 as a liquid ejecting apparatus according to an embodiment of the invention will be described in detail with reference to accompanying drawings.

First, an outline of the recording apparatus 1 according to the embodiment will be described.

Figure 1:
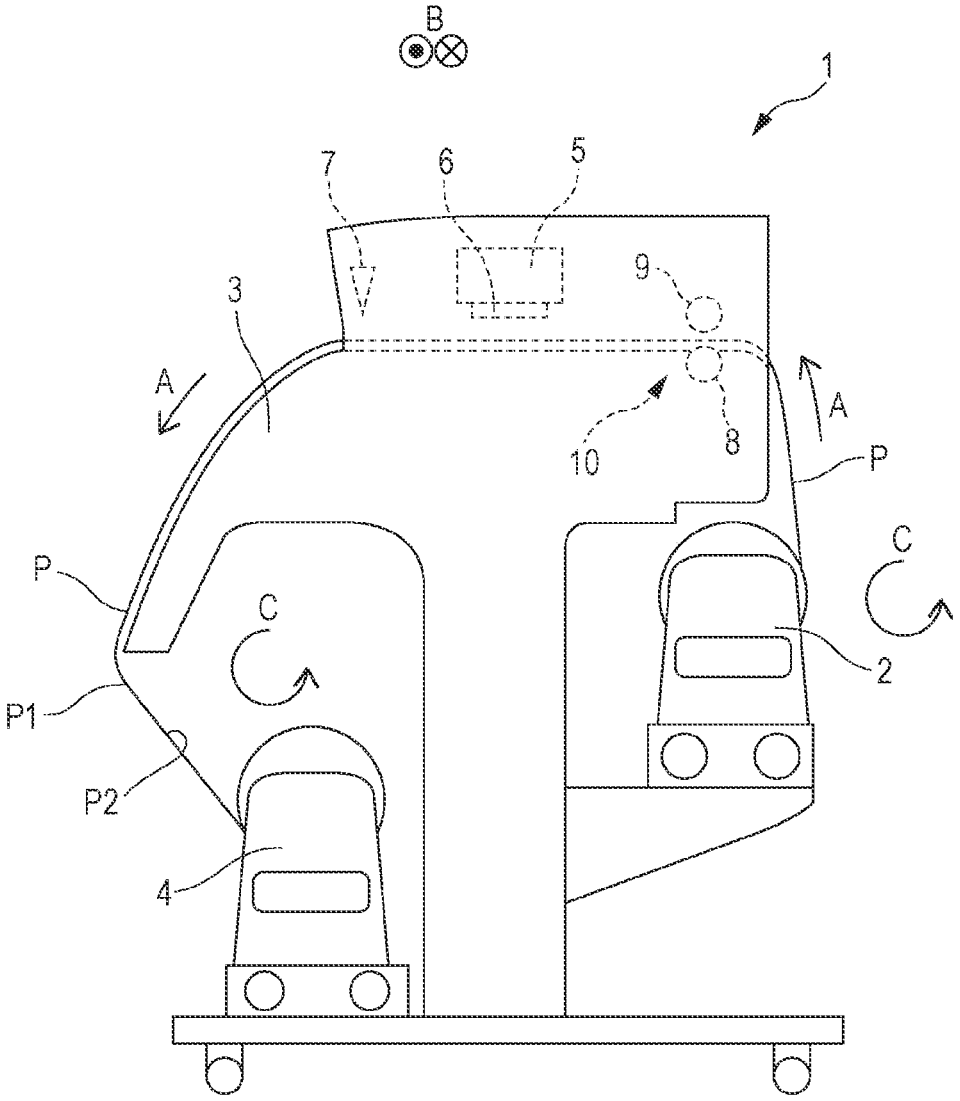
FIG. 1 is a schematic side view which illustrates a recording apparatus according to an embodiment of the invention.

FIG. 1 is a schematic side view which illustrates the recording apparatus 1 according to the embodiment.

As illustrated in FIG. 1, the recording apparatus 1 according to the embodiment includes a setting unit 2 of a recording medium (medium) P in a roll shape. In addition, it is possible to transport the recording medium P in a first direction A as a transport direction to a winding unit 4 which can wind up the recording medium P in the roll shape through a platen 3 which is a support unit of the recording medium P from the setting unit 2. That is, a path between the setting unit 2 and the winding unit 4 is a transport path of the recording medium P in the recording apparatus 1, and the platen 3 is the support unit of the recording medium P which is provided in the transport path. In addition, the setting unit 2 sends out the recording medium P by rotating the recording medium P in a rotation direction C which is a first rotation direction, and the winding unit 4 winds up the recording medium P by rotating in the rotation direction C.

Here, FIG. 1 illustrates a setting state of the recording medium P in which recording can be performed on a first face P1 which is the outer face of the roll of the recording medium P. In this case, the setting unit 2 is rotated in the rotation direction C. Meanwhile, it is also possible to perform recording on a second face P2 which is the inner face of the roll of the recording medium P, and in such a case, the setting unit 2 is rotated in a rotation direction opposite to the rotation direction C.

In addition, similarly, since the winding unit 4 according to the embodiment is in a state of winding the first face P1 of the recording medium P so as to be the outer side in FIG. 1, the winding unit 4 rotates in the rotation direction C. Meanwhile, it is also possible to perform winding so that the first face P1 becomes the inside. In such a case, the winding unit 4 rotates in a rotation direction which is opposite to the rotation direction C.

In the recording apparatus 1 according to the embodiment, a transporting unit 10 which is configured of a pair of rollers including a rotation axis in an intersecting direction B which intersects the first direction A is provided in the transport path of the recording medium P. The transporting unit 10 is configured of a driving roller 8 which applies a transport force to the recording medium P, and a pair of transport rollers which is configured of a driven roller 9 which is provided at a position facing the driving roller 8. With such a configuration, in the recording apparatus 1 according to the embodiment, the transporting unit 10 transports the recording medium P which is sent out from the setting unit 2 in the transport path of the recording medium P, and the winding unit 4 winds up the recording medium P which is transported to the winding unit 4 using the transporting unit 10. That is, the liquid ejecting apparatus includes the transporting unit 10 which can transport the recording medium P along the first direction A.

In the recording apparatus 1 according to the embodiment, it is possible to transport the recording medium P in the first direction A by driving the setting unit 2, the winding unit 4, and the transporting unit 10, and it is also possible to transport the recording medium P in reverse in a second direction which is a direction opposite to the first direction. That is, the transporting unit 10 can switch the case in which the recording medium P is transported in the first direction A to the case in which the recording medium P is transported in reverse in the second direction which is a direction opposite to the first direction.

The recording apparatus 1 according to the embodiment includes a recording head 6 as an ejecting unit of ink (example of liquid) on a side facing the platen 3 as a medium support unit in the transport path of the recording medium P. The recording apparatus 1 forms a desired image by ejecting ink onto the recording medium P from a nozzle forming face of the recording head 6 while causing the recording head 6 to perform a reciprocating movement in the intersecting direction B through a carriage 5. With such a configuration, the recording head 6 can form an image by ejecting ink onto the recording medium P. In conclusion, the liquid ejecting apparatus includes an ejecting unit 6 which can eject liquid.

The recording apparatus 1 according to the embodiment is configured of the recording head 6 which performs recording while performing reciprocating movement in the intersecting direction B. For this reason, the transporting unit 10 has a configuration in which it is possible to intermittently transport the recording medium P corresponding to the recording head 6 with such a configuration.

Specifically, the recording apparatus 1 according to the embodiment performs recording in the following procedure.

In addition, the following various operations are executed when a control unit 11 performs controlling.

First, ink is ejected from the recording head 6 onto the recording medium P which is transported to a predetermined recording region (refer to FIGS. 3 to 11) which can face the nozzle forming face in a state in which transporting of the recording medium P is stopped while moving the recording head 6 in the intersecting direction B.

Subsequently, the recording medium P is transported in the first direction A by a predetermined transport amount. This is also referred to as a transport operation after ejecting. Ink is not ejected from the recording head 6 during the transport of the recording medium P. The predetermined transport amount is the first distance L1 (refer to FIG. 4) which corresponds to the ejecting width of ink in the first direction A using the recording head 6.

Here, "corresponding to the ejecting width" means, for example, the forming length of a nozzle in the first direction A of the recording head 6 (movement amount of one time when performing so-called one-pass recording), the recording length in the first direction A of one pass (movement amount of one time) in a case in which so-called multipass recording in which an image is formed at the same portion of the recording medium P along with a plurality of reciprocating movements in the intersecting direction B is performed, or the like.

In addition, ink is ejected from the recording head 6 while moving the recording head 6 in the intersecting direction B in a state in which transporting of the recording medium P is stopped. In conclusion, the control unit 11 executes the transport operation after ejecting in which the recording medium P is transported by the first distance using the transporting unit 10 after the ejecting operation.

Hereinafter, recording of an image is completed by repeating such operations.

The recording apparatus 1 according to the embodiment further includes a cutter 7 as a cutting unit of the recording medium P on the downstream side of the recording head 6 in the first direction A. The cutter 7 according to the embodiment is configured so as to move in the intersecting direction B, and to cut the recording medium P in a direction intersecting the first direction A by moving in the intersecting direction B. However, the configuration of the cutting unit of the recording medium P is not particularly limited. That is, the liquid ejecting apparatus includes a cutting unit 7 which is provided on the downstream side compared to the ejecting unit 6 in the first direction A, and can cut the recording medium P.

Subsequently, an electric configuration in the recording apparatus 1 according to the embodiment will be described.

Figure 2:
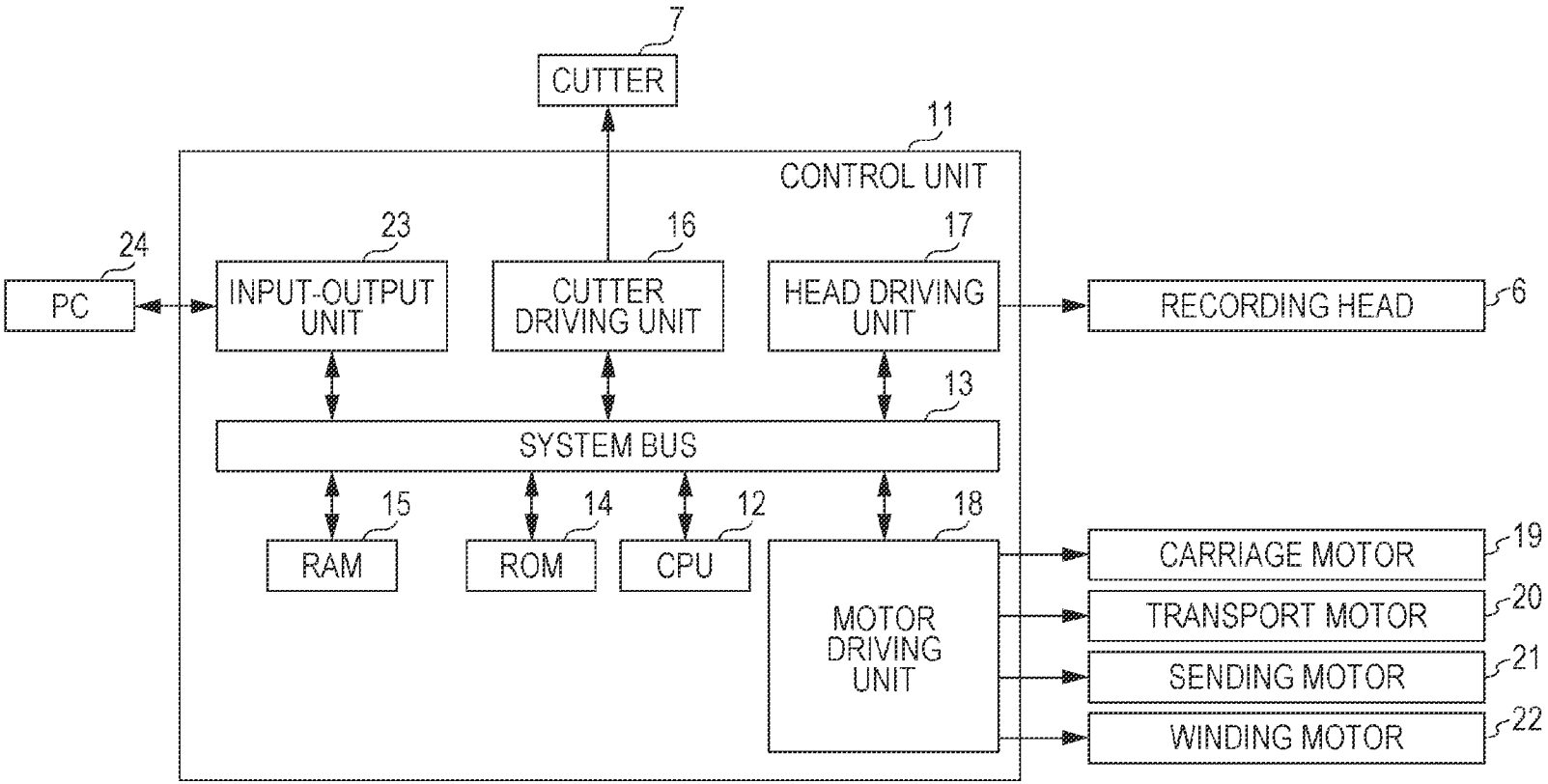
FIG. 2 is a block diagram which illustrates the recording apparatus according to the embodiment of the invention.

FIG. 2 is a block diagram of the recording apparatus 1 according to the embodiment.

The control unit 11 is provided with a CPU 12 which performs the entire control of the recording apparatus 1. The CPU 12 is connected to a ROM 14 which stores various control programs which are executed by the CPU 12, and a RAM 15 which can temporarily store data through a system bus 13.

In addition, the CPU 12 is connected to a cutter driving unit 16 for driving the cutter 7 through the system bus 13.

In addition, the CPU 12 is connected to a head driving unit 17 for driving the recording head 6 through the system bus 13.

The CPU 12 is further connected to a motor driving unit 18 which is connected to a carriage motor 19, a transport motor 20, a sending motor 21, and a winding motor 22 through the system bus 13.

Here, the carriage motor 19 is a motor for moving the carriage 5 on which the recording head 6 is mounted in the intersecting direction B. In addition, the transport motor 20 is a motor for driving a driving roller 8 of the transporting unit 10. The sending motor 21 is a driving mechanism of the setting unit 2, and is a motor for rotating the setting unit 2 for sending out the recording medium P to the transporting unit 10. In addition, the winding motor 22 is a motor for rotating the winding unit 4.

In addition, the CPU 12 is connected to an input-output unit 23 which is connected to a PC 24 for performing transmitting and receiving of data such as recording data, and a signal through the system bus 13.

It is possible for the control unit 11 according to the embodiment to control the recording head 6, the transporting unit 10, the cutter 7, and the like with such a configuration. That is, the control unit controls executing of a transport operation of the recording medium P using the transporting unit 10, executing of an ejecting operation of ink using the recording head 6 and executing of a cutting operation of the recording medium P using the cutter 7. In other words, the liquid ejecting apparatus includes the control unit 11 which can execute an ejecting operation in which liquid is ejected onto the recording medium P using the ejecting unit 6, and a cutting operation in which the recording medium P is cut using the cutting unit 7.

In addition, though it will be described later in detail, the control unit 11 performs a control so that a transport operation is executed after executing a cutting operation, and before executing an ejecting operation, when the ejecting operation is executed after executing the cutting operation.

There is a case in which the recording medium P moves in the intersecting direction B when the recording medium P is cut using the cutter 7. However, when a transport operation is executed with respect to the recording medium P which moves in the intersecting direction B in this manner, there is a tendency that the recording medium P which moves in the intersecting direction B returns to the original position in the intersecting direction B.

The control unit 11 according to the embodiment performs a control so that a transport operation is executed after executing a cutting operation and before executing an ejecting operation, when executing the ejecting operation after executing the cutting operation. For this reason, a transport operation is certainly executed after executing a cutting operation. Accordingly, it is possible to make a recording medium P return to the original position using a transport operation, even when the recording medium P moves in the intersecting direction B along with cutting of the recording medium P, and it is possible to suppress a landing failure of ink when performing recording which is associated with cutting of the recording medium P.

Subsequently, a specific control method of the control unit 11 when performing a transport operation of the recording medium P, an ink ejecting operation, and a cutting operation of the recording medium P in the recording apparatus 1 according to the embodiment will be described.

FIGS. 3 to 13 are schematic diagrams which describe a transport operation when performing recording using the recording apparatus 1 according to the embodiment.

Here, the embodiment is an example of a case in which an image I1 is formed on the recording medium P, and an image I2 is formed in succession.

Figure 3:
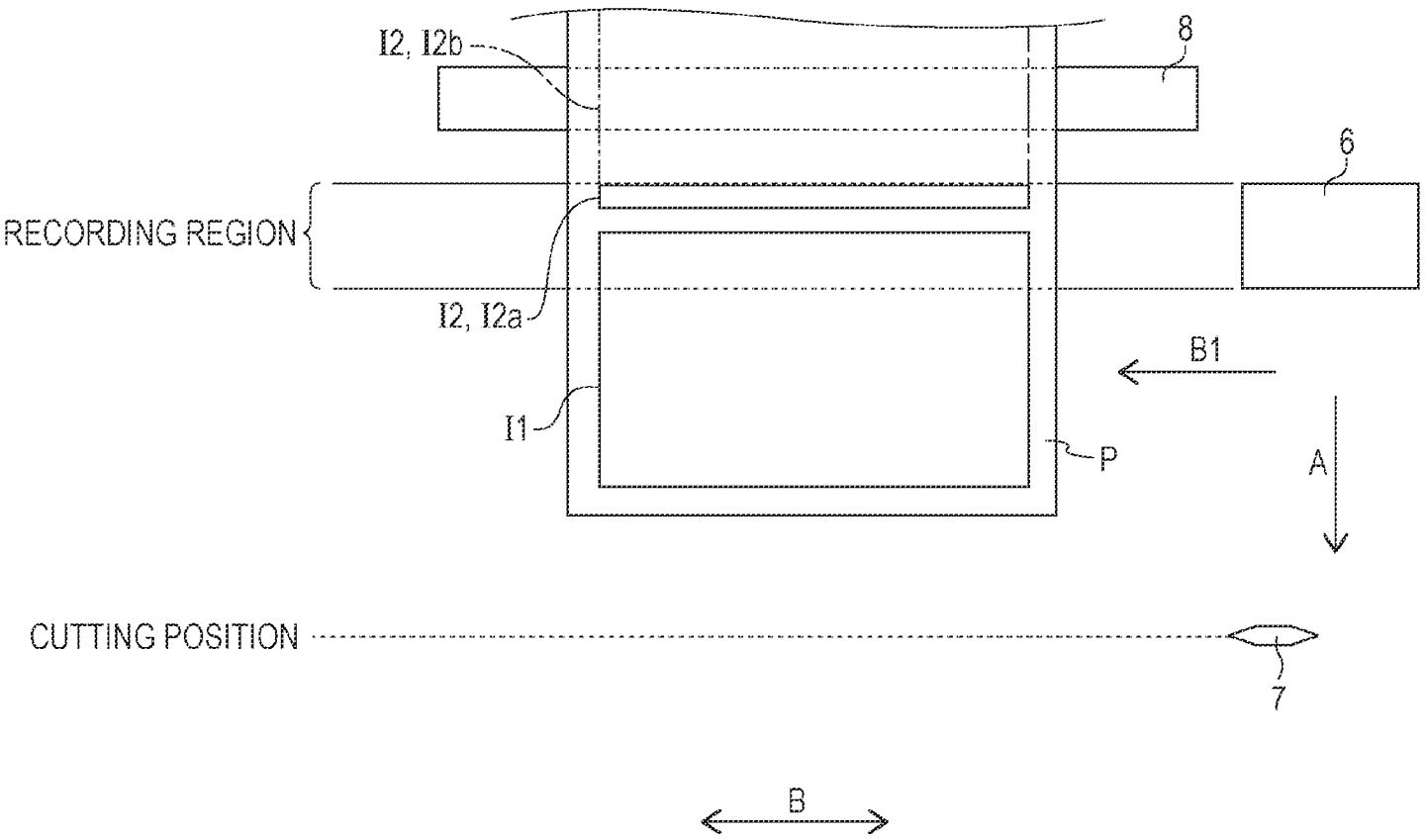
FIG. 3 is a schematic diagram which describes a transport operation when performing recording using the recording apparatus according to the embodiment of the invention.

FIG. 3 illustrates a state in which the images I1 and I2 are in the middle of being formed, and a state in which an ink ejecting operation is about to be performed which is associated with a movement of the recording head 6 in the subsequent times in the outward direction B1, in the intersecting direction B.

When the ink ejecting operation which is associated with the movement of the recording head 6 in the outward direction B1 is executed in the state in FIG. 3, an upstream side portion in the first direction A of the image I1, and a downstream side portion in the first direction A of the image I2 corresponding to a recording region in the figure are recorded.

In the image I1, the entire region is a region in the middle of being recorded, or a region in which recording is completed; however, an image I2*a* in the image I2 corresponds to a region in the middle of being recorded, or a region in which recording is completed, and an image I2*b* in the image I2 corresponds to a region which will be recorded.

Figure 4:
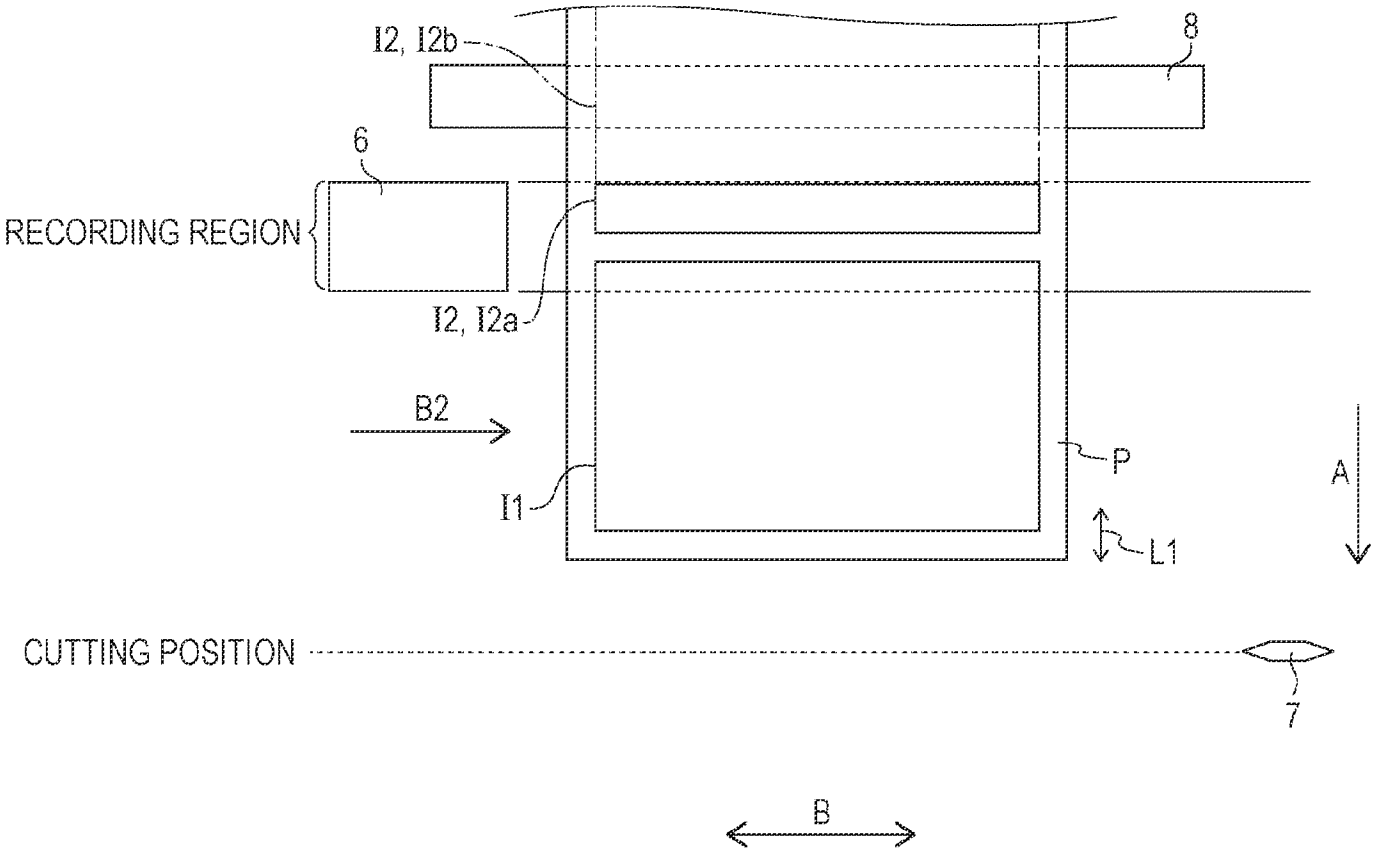
FIG. 4 is a schematic diagram which describes a transport operation when performing recording using the recording apparatus according to the embodiment of the invention.

FIG. 4 illustrates a state in which an ink ejecting operation associated with a movement of the recording head 6 in the outward direction B1 is executed from a state in FIG. 3, and the recording medium P is already transported by a predetermined transport amount (first distance L1), and a state in which an ink ejecting operation associated with a movement in the return direction B2, in the intersecting direction B is about to be performed.

When the ink ejecting operation associated with the movement of the recording head 6 in the return direction B2 is executed from the state in FIG. 4, an upstream side portion in the first direction A of the image I1, and a downstream side portion in the first direction A of the image I2 corresponding to a recording region in the figure are recorded. However, a position corresponding to the recording region in the recording medium P (position of landing region of ink) is deviated by the first distance L1 to the upstream side in the first direction A with respect to a case when the ink ejecting operation is executed from the state in FIG. 3.

Figure 5:
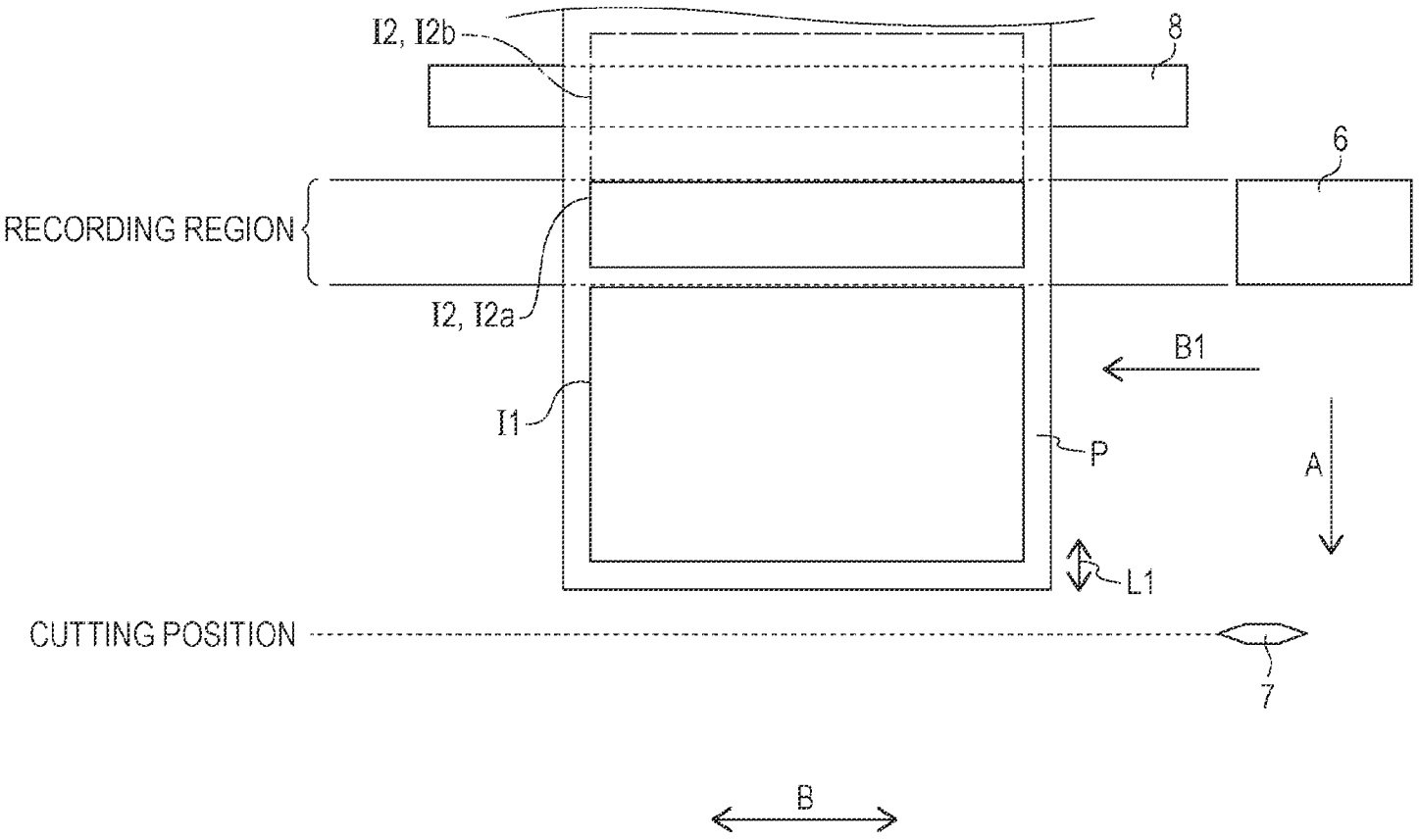
FIG. 5 is a schematic diagram which describes a transport operation when performing recording using the recording apparatus according to the embodiment of the invention.

FIG. 5 illustrates a state in which an ink ejecting operation associated with a movement in the return direction B2 of the recording head 6 is executed from the state in FIG. 4, and a state in which the recording medium P is already transported by the first distance L1, and in which an ink ejecting operation associated with the movement in the outward direction B1 is about to be performed.

When the ink ejecting operation associated with the movement of the recording head 6 in the outward direction B1 is executed from the state in FIG. 5, a downstream side portion of the image I2 in the first direction A corresponding to the recording region in the figure is recorded.

Figure 6:
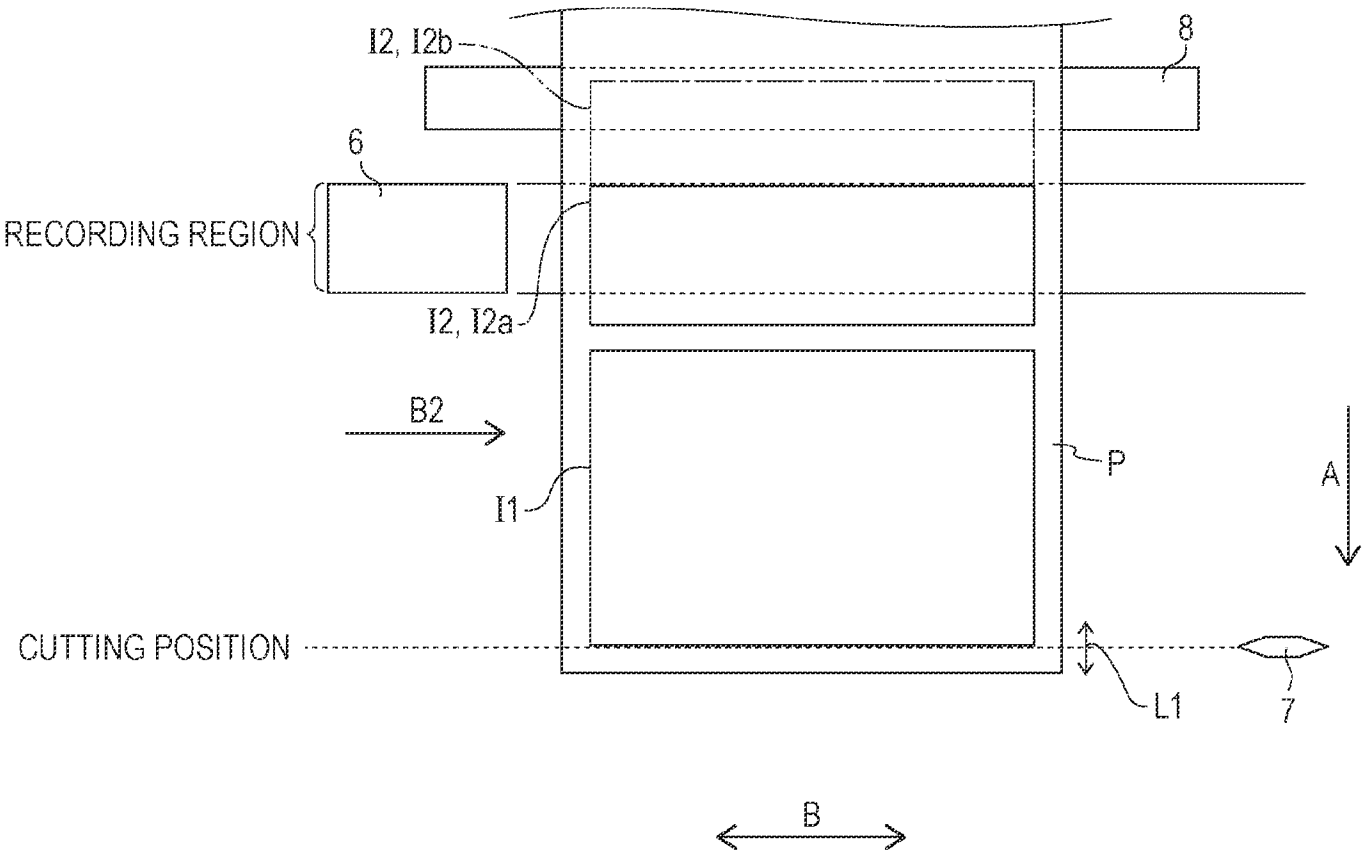
FIG. 6 is a schematic diagram which describes a transport operation when performing recording using the recording apparatus according to the embodiment of the invention.

FIG. 6 illustrates a state in which the ink ejecting operation associated with the movement of the recording head 6 in the outward direction B1 is executed from the state in FIG. 5, and a state in which the recording medium P is already transported by the first distance L1. In addition, FIG. 6 illustrates a state in which an ink ejecting operation associated with a movement in the return direction B2 is not executed yet, and in which the recording medium P is exactly at a cutting position in relation with a transport position of the image I1.

Here, the control program of the control unit 11 which is stored in the ROM 14 has a configuration in which a cutting operation of the recording medium P is executed before an ink ejecting operation in a state in which a position of the recording medium P after being transported by the first distance L1 matches the cutting position of the recording medium P.

Then, in the state in FIG. 6, when a cutting operation for cutting the recording medium P by moving the cutter 7 in the outward direction B1 is executed before an ink ejecting operation associated with a movement of the recording head 6 in the return direction B2, the ink ejecting operation is performed in a state in which the recording medium P is deviated in the intersecting direction B due to the cutting operation of the recording medium P.

Figure 7:
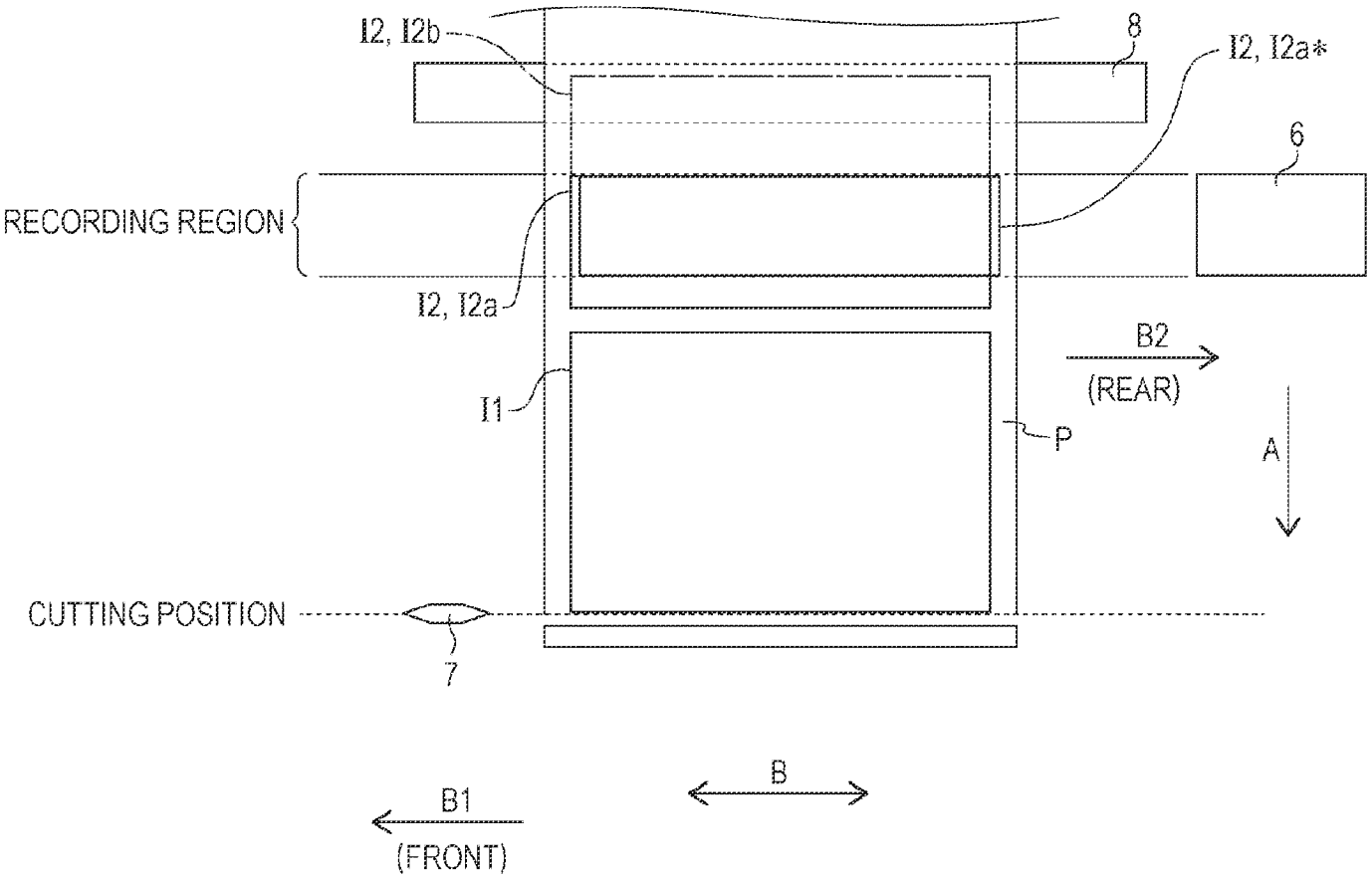
FIG. 7 is a schematic diagram which describes a transport operation when performing recording using the recording apparatus according to the embodiment of the invention.

FIG. 7 illustrates such a state. As illustrated in FIG. 7, if the recording medium P is deviated on the left side in the figure when the cutter 7 moves in the outward direction B1, and when an ink ejecting operation is performed in this state, an image I2*a** which is formed associated with the ink ejecting operation is formed by being deviated in the intersecting direction B.

Therefore, the recording apparatus 1 according to the embodiment has a configuration in which such malfunction can be suppressed.

Specifically, when the recording medium P enters the state in FIG. 6 by being transported by the first distance L1 from the state in FIG. 5, a transport distance of the recording medium P of one time which is associated with the intermittent transport from the state in FIG. 5 is changed to a second distance L1* which is shorter than the first distance L1 due to a control of the control unit 11.

Figure 8:
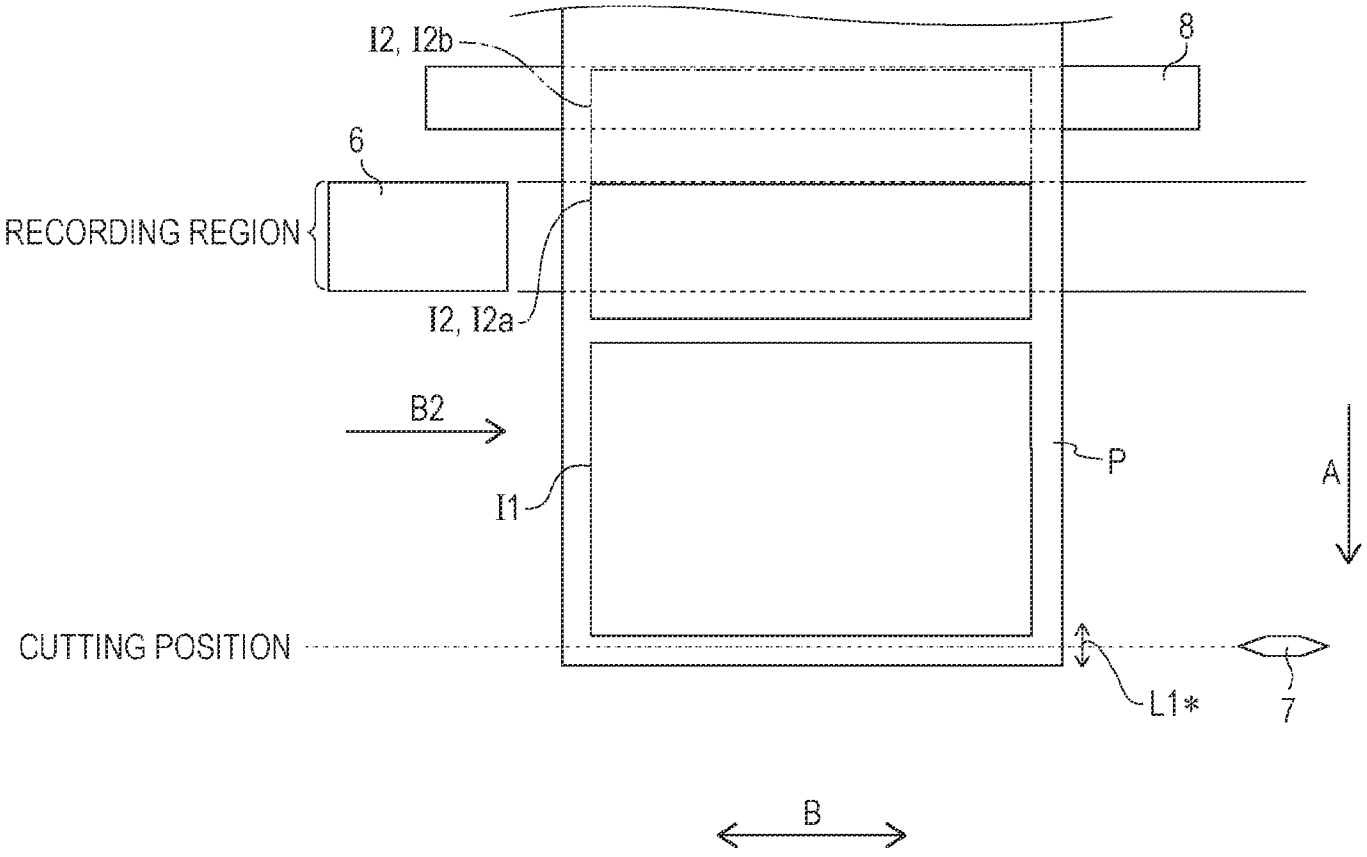
FIG. 8 is a schematic diagram which describes a transport operation when performing recording using the recording apparatus according to the embodiment of the invention.

That is, it is transferred from the state in FIG. 5 to a state in FIG. 8, not the state in FIG. 6.

FIG. 8 illustrates a state in which an ink ejecting operation associated with a movement of the recording head 6 in the outward direction B1 is executed from the state in FIG. 5, and the recording medium P is already transported by the second distance L1* which is shorter than the first distance L1. In addition, FIG. 8 illustrates a state in which an ink ejecting operation associated with the movement in the return direction B2, similarly to FIG. 6, is not performed yet.

Figure 9:
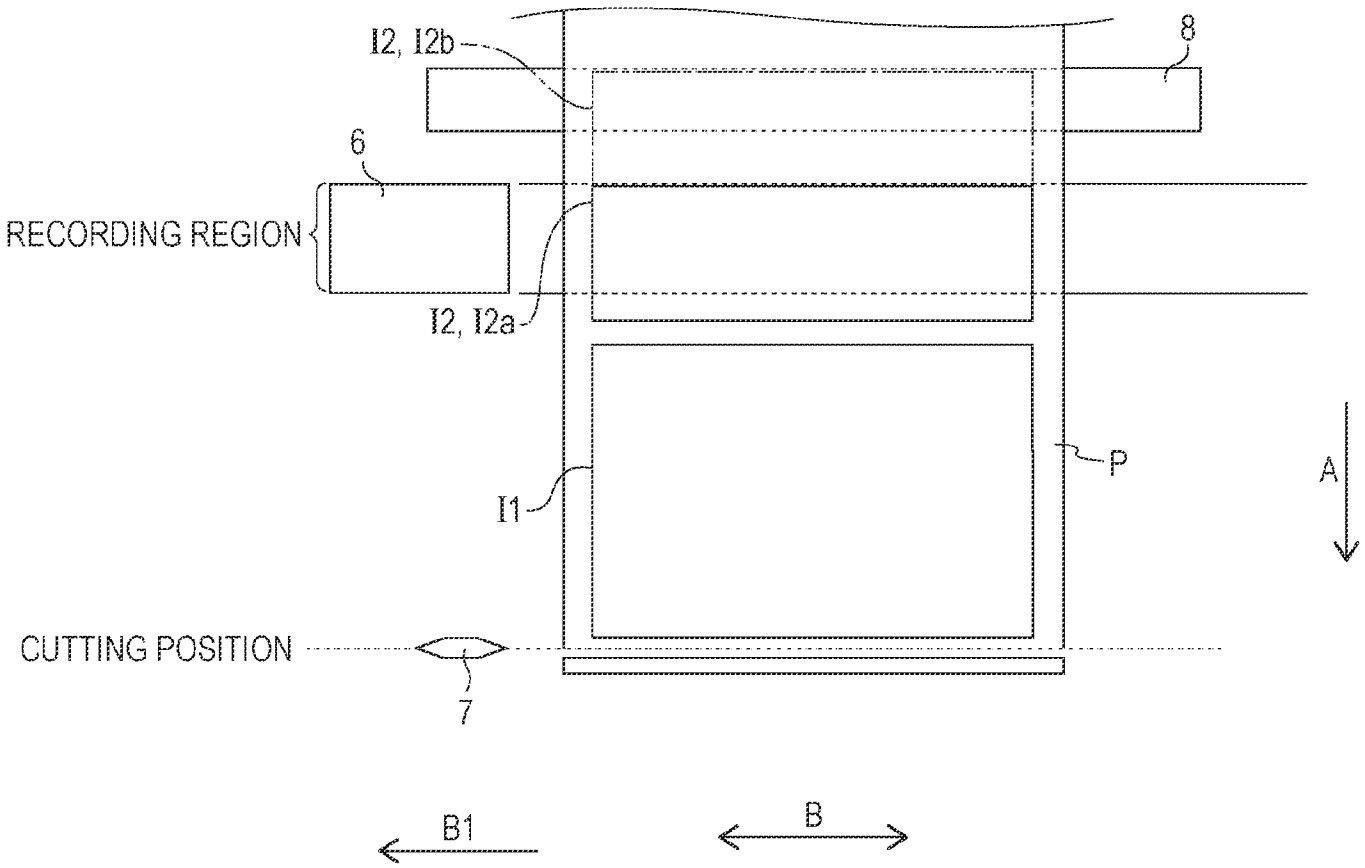
FIG. 9 is a schematic diagram which describes a transport operation when performing recording using the recording apparatus according to the embodiment of the invention.

In FIG. 8, upon comparison with FIG. 6, it is clear that a position of the recording medium P is deviated with respect to the state in FIG. 6. The recording apparatus 1 according to the embodiment executes cutting of the recording medium P at a position of the recording medium P which is illustrated in FIG. 8. FIG. 9 illustrates a state in which cutting of the recording medium P is performed at the position of the recording medium P which is illustrated in FIG. 8.

Figure 10:
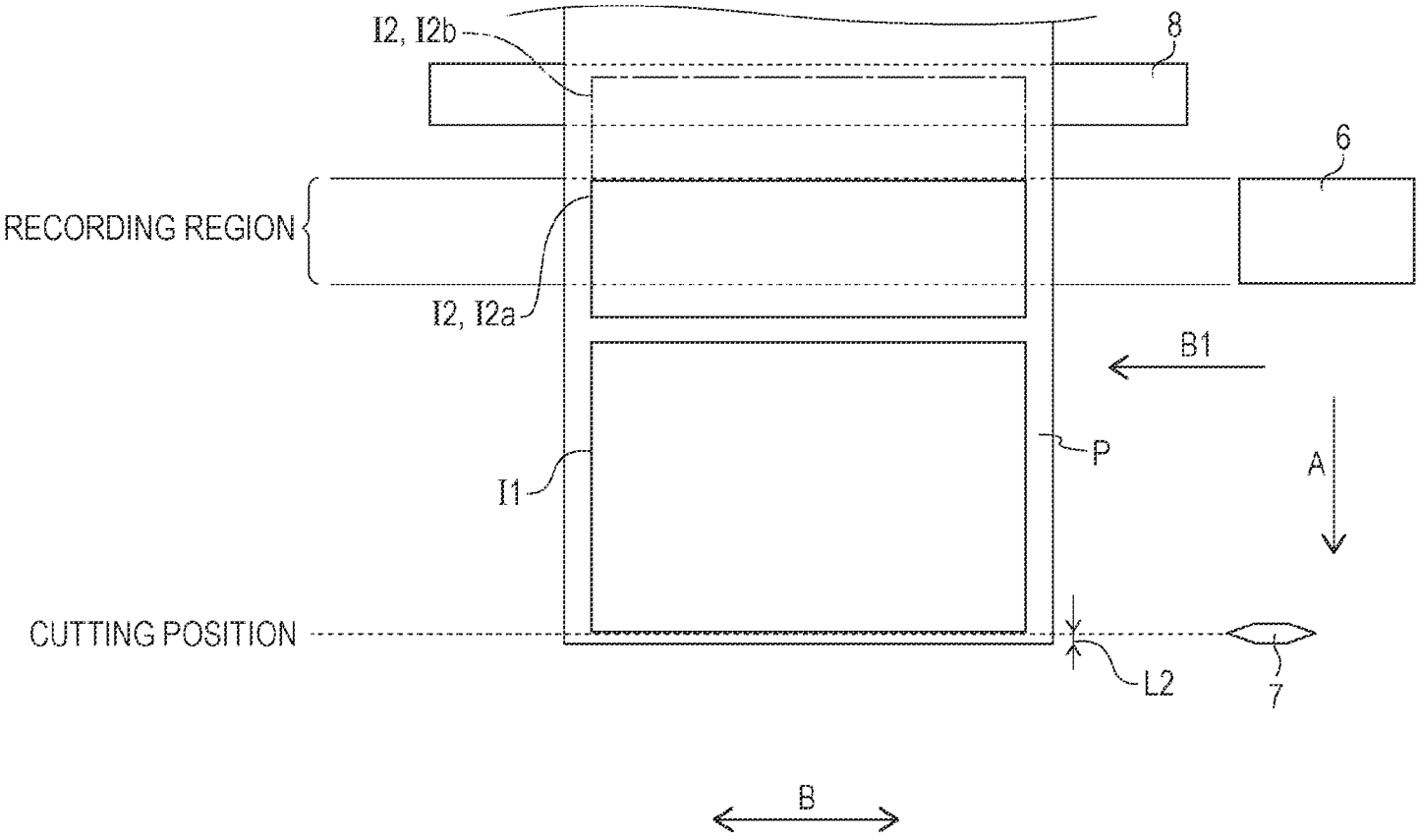
FIG. 10 is a schematic diagram which describes a transport operation when performing recording using the recording apparatus according to the embodiment of the invention.

In addition, the recording medium P is transported from the state illustrated in FIG. 9 by a distance L2 which corresponds to a difference between the first distance L1 and the second distance L1* which is a movement distance when the recording medium P is moved from the state in FIG. 5 to the state in FIG. 8. FIG. 10 illustrates the state. Transporting by the distance L2 which is performed after cutting the recording medium P is also referred to as a post-cutting transport operation. That is, the control unit 11 executes the post-cutting transport operation in which the recording medium P is transported using the transporting unit 10 between executing of the cutting operation and executing of the ejecting operation. By executing such a post-cutting transport operation, it is possible to correct a position deviation of the recording medium P which occurs due to cutting, and to suppress a landing failure of liquid associated with cutting of the recording medium P.

In addition, by executing the ink ejecting operation which is associated with the movement of the recording head 6 in the outward direction B1, recording of the image I2 is executed from the state illustrated in FIG. 10. In addition, a recording operation (ink ejecting operation) is continued by returning a transport distance of the recording medium P to first distance thereafter.

It is needless to say that a recording method is also adapted (recording data in which recording of one pass is performed is changed, or the like) in accordance with transfer from the state in FIG. 5 to the state in FIG. 8, instead of transfer from the state in FIG. 5 to the state in FIG. 6 in this manner.

In this manner, the control unit 11 according to the embodiment can control a transport distance of the recording medium P associated with the transport operation of the recording medium P after executing a cutting operation of the recording medium P and before executing an ink ejecting operation so as to be the distance L2 which is shorter than the first distance L1. That is, the control unit 11 sets the transport distance of the recording medium P in the post-cutting transport operation to be shorter than the first distance.

That is, the transport operation is executed after cutting the recording medium P, and before the ink ejecting operation by executing a micro transport of which a distance is the distance L2, and it is possible to suppress a landing failure of ink which is associated with cutting of the recording medium P.

In addition, since the cutter 7 according to the embodiment does not move in the first direction A, a cutting position of the recording medium P deviates to some extent. However, it is possible to prevent the cutting position from being remarkably deviated (suppressing deviation of cutting position) by setting the distance L2 to a micro distance, even when the cutting unit does not move in the first direction A like the cutter 7 according to the embodiment.

As described above, the control unit 11 according to the embodiment changes the subsequent transport distance in the intermittent transport to the second distance L1* which is shorter than the first distance L1, when a stop position of a position to be cut (end portion of image) in the recording medium P after performing the subsequent transport by the first distance L1 in the intermittent transport matches the cutting position of the recording medium P using the cutter 7. Such a transport operation before a cutting operation is also referred to as a pre-cutting transport operation. That is, the control unit 11 executes the pre-cutting transport operation in which the recording medium P is transported before executing the cutting operation using the transporting unit 10. The control unit 11 controls the ejecting operation of ink, the pre-cutting transport operation, and the cutting operation of the recording medium P in this order. In addition, the control unit performs control so that a transport distance in the subsequent transport after transporting by the second distance L1* is set to the distance L2 which is a distance that is the difference between the first distance L1 and the second distance L1*.

That is, the control unit 11 according to the embodiment can control so that, when it is a state illustrated in FIG. 5, the state is set to the state illustrated in FIG. 8 (in addition, states illustrated in FIGS. 9 and 10), not the state illustrated in FIG. 6 after the subsequent transport in the intermittent transport.

Accordingly, when the stop position of the recording medium P based on the intermittent transport matches the cutting position of the recording medium P, the control unit executes recording (ink ejecting operation) by shifting a transport amount of the recording medium P before cutting in the intermittent transport, and further executing cutting of the recording medium P, and executes transporting by the distance L2 after transporting by the second distance L1*. In other words, the control unit 11 sets the transport distance in the pre-cutting transport operation to the second distance L1* which is shorter than the first distance L1, when a position of the recording medium P to be cut matches the cutting position using the cutter 7, if a distance for transporting the recording medium P is the first distance L1 in the pre-cutting transport operation. In addition, the control unit 11 transports the recording medium P by a distance that is the difference between the first distance L1 and the second distance L1* in the post-cutting transport operation. For this reason, when the stop position of the recording medium P based on the intermittent transport matches the cutting position of the recording medium P, it is possible to suppress a landing failure of ink which is associated with cutting of the recording medium P. At the same time, it is possible to suppress an occurrence of deviation in landing position of ink which is associated with a change in transport amount in one intermittent transport (change from first distance L1 to second distance L1* and distance L2).

Figure 11:
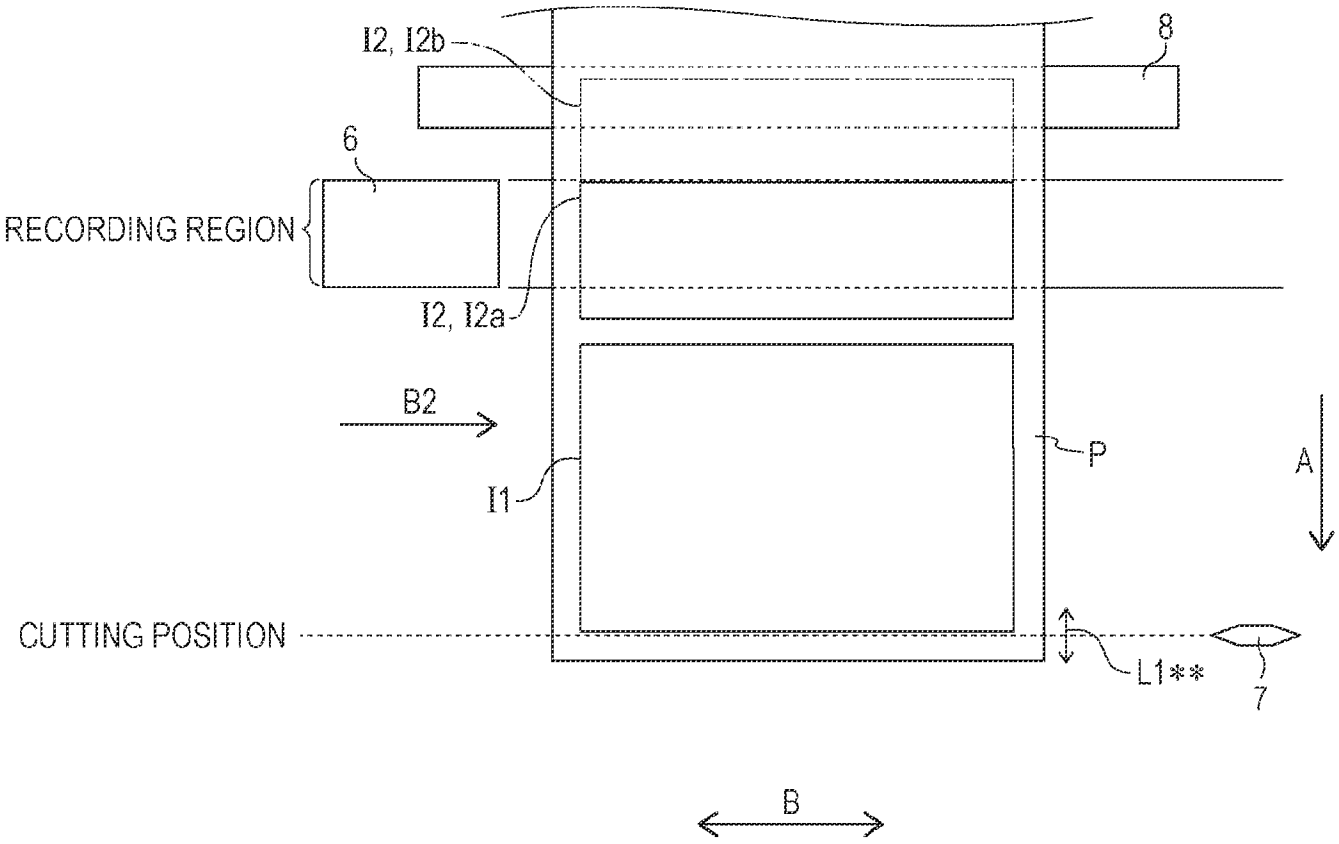
FIG. 11 is a schematic diagram which describes a transport operation when performing recording using the recording apparatus according to the embodiment of the invention.
Figure 12:
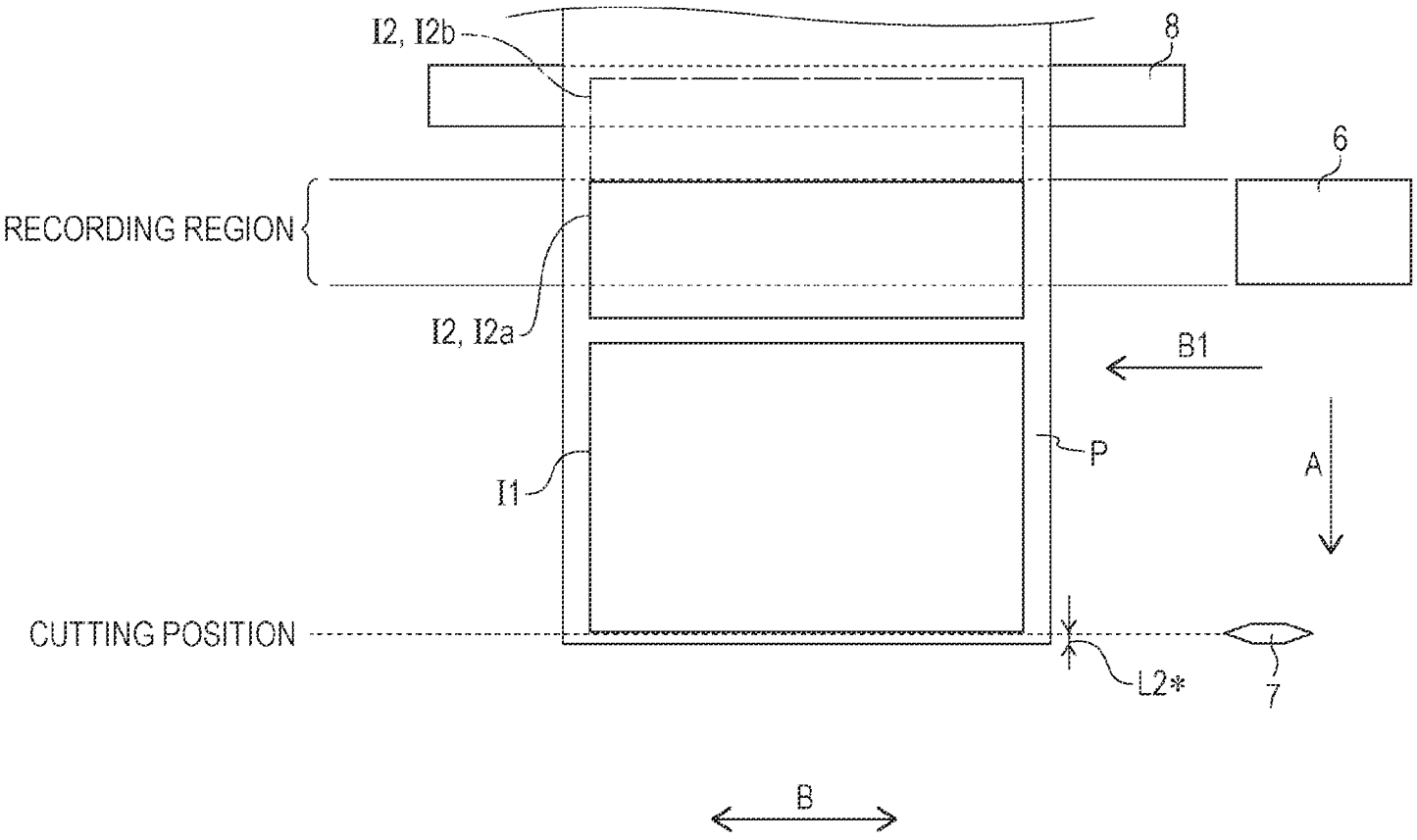
FIG. 12 is a schematic diagram which describes a transport operation when performing recording using the recording apparatus according to the embodiment of the invention.

The control unit 11 according to the embodiment performs a control so that an ink ejecting operation after transporting by the third distance L1, and the cutting operation of the recording medium P are executed in this order when a stop position of a position to be cut (end portion of image) in the recording medium P after the subsequent transporting by the first distance L1 in the intermittent transport does not match the cutting position of the recording medium P, and when the subsequent transport distance of the recording medium P in the intermittent transport in relation with the cutting position is a third distance L1** which is shorter than the first distance L1 (refer to FIG. 11). In addition, the control unit performs a control so that a transport distance in the subsequent transport after transporting by the third distance L1** to be a distance L2* which is a distance that is the difference between the first distance L1 and the third distance L1** (refer to FIG. 12**).

That is, when the stop position of the recording medium P based on the intermittent transport does not match the cutting position of the recording medium P, cutting of the recording medium P is executed after executing landing of ink, after transporting the recording medium by the third distance L1, and transporting of the recording medium by the distance L2* is executed. In conclusion, when a transport distance of the recording medium P is the first distance L1 in the pre-cutting transport operation in a case in which a position of the recording medium P to be cut does not match the cutting position by the cutting unit 7, the control unit 11 sets the transport distance in the pre-cutting transport operation to the third distance L1** which is shorter than the first distance L1. In addition, the control unit 11 transports the recording medium P by a distance that is the difference between the first distance L1 and the third distance L1** in the post-cutting transport operation. For this reason, when the cutting position of the recording medium P based on the intermittent transport does not match the cutting position of the recording medium P, it is possible to suppress a landing failure of ink which is associated with cutting of the recording medium P. At the same time, it is possible to suppress the occurrence of a deviation in the landing position of ink which is associated with a change in transport amount in one intermittent transport (change from first distance L1 to third distance L1** and distance L2*) by setting the sum of the third distance L1** and the distance L2* to be the first distance L1. In addition, the second distance L1* and the third distance L1**** may be the same as each other, or may be different from each other.

It is preferable to set a transport distance of the recording medium P which is associated with a transport operation of the recording medium P after executing a cutting operation of the recording medium P and before executing an ink ejecting operation, that is, the distances L2 and L2* to be equal to or greater than 0.1 mm and equal to or smaller than 0.5 mm. In other words, it is preferable to set the transport distance of the recording medium P in the post-cutting transport operation to be equal to or greater than 0.1 mm and equal to or smaller than 0.5 mm.

When the distances L2 and L2* are equal to or greater than 0.1 mm, it is a transport distance which is sufficient for returning the recording medium P which moves in the intersecting direction B to the original position in the intersecting direction B. In addition, the distances L2 and L2* correspond to the deviation of the cutting position of the recording medium P. At this time, when the distances L2 and L2* are equal to or smaller than 0.5 mm, the deviation in cutting position of the recording medium P falls within the allowable range as a printing matter.

Here, in the recording apparatus 1 according to the embodiment, a transport direction of the recording medium P which is associated with the transport operation of the recording medium P after executing a cutting operation of the recording medium P and before executing an ink ejecting operation is the first direction A which is the first direction. That is, the control unit 11 transports the recording medium P in the first direction A in the post-cutting transport operation. For this reason, it is possible to suppress a landing failure of ink which is associated with cutting of the recording medium P, by executing the transport operation in the first direction A which is the first direction.

However, it is not limited to such a configuration, and in the transport operation of the recording medium P after executing the cutting operation of the recording medium P and before executing the ink ejecting operation, the recording medium P may be transported in reverse in the second direction (that is, a reverse transport direction) which is a direction opposite to the first direction A. In other words, the control unit 11 may transport the recording medium P to the second direction which is the direction opposite to the first direction A, in the post-cutting transport operation.

In addition, a configuration in which it is possible to recognize the width of the recording medium P by including a sensor, or the like, in the recording apparatus 1 may be adopted. Alternatively, a user may be caused to input the width of the recording medium P. In addition, a configuration in which a transport distance of the recording medium P which is associated with the transport operation thereof after executing the cutting operation of the recording medium P and before executing the ink ejecting operation, that is, the distances L2 and L2* can be changed according to the width of the recording medium P may be adopted. In addition, the "width of the recording medium P" means the length of the recording medium P in the intersecting direction B (width direction). In other words, it is possible to change a transport distance of the recording medium P in the post-cutting transport operation based on the length of the recording medium P in the width direction which is a direction intersecting the first direction A. Specifically, a case in which the width of the recording medium P is small rather than a case in which the width of the recording medium P is large may be set to a configuration in which it is possible to generate a change so that the transport distance becomes long. In other words, the control unit 11 may set the transport distance of the recording medium P in the post-cutting transport operation, when the length of the recording medium P in the width direction is the first length, to be longer than the transport distance of the recording medium P in the post-cutting transport operation when the length of the recording medium P in the width direction is the second length which is longer than the first length.

In a case in which the width of the recording medium P is small rather than a case in which the width of the recording medium P is large, a movement of the recording medium P in the intersecting direction which intersects the first direction A when cutting the recording medium P becomes large. For this reason, by adopting such a configuration, it is possible to set a transport distance of the recording medium P which is associated with the transport operation of the recording medium P after executing the cutting operation of the recording medium P and before executing the ink ejecting operation to an appropriate distance.

As described above, the control program of the control unit 11 which is stored in the ROM 14 in the recording apparatus 1 according to the embodiment has a configuration in which a cutting operation of the recording medium P is executed before an ink ejecting operation, in a state in which a position of the recording medium P after transporting by the first distance L1 matches the cutting position of the recording medium P.

However, a recording apparatus in which a control program with a configuration in which an ink ejecting operation is executed before a cutting operation of the recording medium P is executed may be adopted, when a position of the recording medium P after transporting by the first distance L1 matches the cutting operation of the recording medium P.

Figure 13:
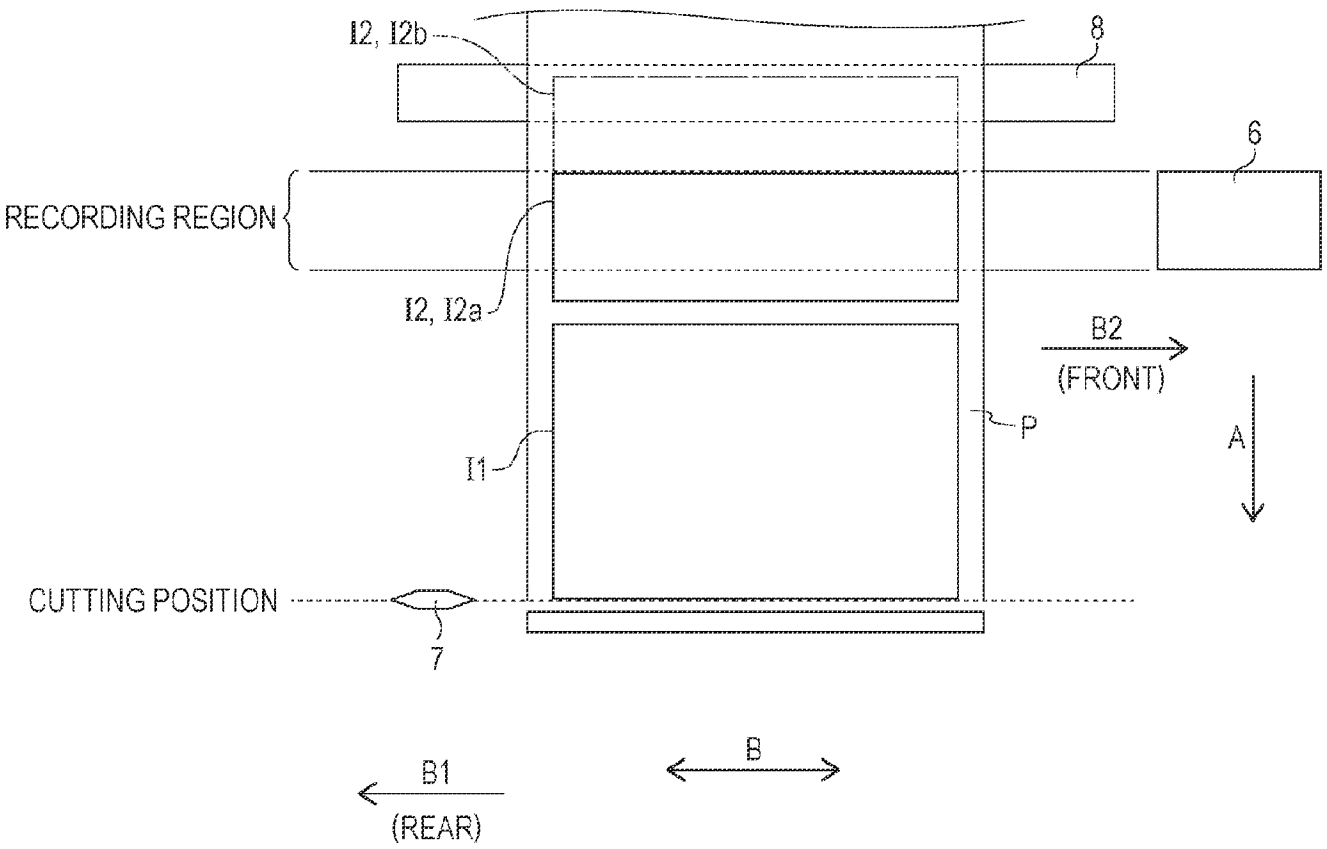
FIG. 13 is a schematic diagram which describes a transport operation when performing recording using the recording apparatus according to the embodiment of the invention.

Specifically, when it is in a state illustrated in FIG. 6, an ink ejecting operation which is illustrated in FIG. 13 is executed before a cutting operation of the recording medium P, not executing a cutting operation of the recording medium P which is illustrated in FIG. 7 before an ink ejecting operation.

In other words, when a stop position of the recording medium P based on the intermittent transport matches the cutting position of the recording medium P, the ink ejecting operation is executed before the cutting operation of the recording medium P. In other words, the control unit 11 executes an ejecting operation between a pre-cutting transport operation and a cutting operation when a distance of transporting the recording medium P in the pre-cutting transport operation is the first distance L1.

That is, when the stop position of the recording medium P based on the intermittent transport matches the cutting operation of the recording medium P, the ink ejecting operation is executed before executing the cutting operation of the recording medium P, and it is possible to prevent the ink ejecting operation from being executed without executing a transport operation after executing the cutting operation of the recording medium P. That is, the transport operation of the recording medium P is executed after executing the cutting operation of the recording medium P and before executing the ink ejecting operation. Accordingly, even in a recording apparatus with such a configuration, it is possible to suppress a landing failure of ink which is associated with cutting of the recording medium P.

In addition, the invention is not limited to the above described embodiment, and it is needless to say that it is possible to perform various modifications in the scope of the invention which is disclosed in claims.

Hitherto, specific embodiments of the invention have been described. Here, the invention will be described once again by being assembled.

A liquid ejecting apparatus 1 according to a first embodiment includes a transporting unit 10 of a medium P, an ejecting unit 6 which can eject ink onto the medium P, a cutting unit 7 of the medium P which is provided on the downstream side compared to the ejecting unit 6 in a first direction A of the medium P using the transporting unit 10, and a control unit 11 which controls executing of a transport operation of the medium P using the transporting unit 10, executing of an ink ejecting operation by the ejecting unit 6 and executing of a cutting operation of the medium P using the cutting unit 7, and the control unit 11 controls the transport operation which is executed after executing of the cutting operation and before executing the ejecting operation, when the ejecting operation is executed after executing the cutting operation.

There is a case in which the medium P moves in an intersecting direction B which intersects the first direction A of the medium P when the medium P is cut using the cutting unit 7. However, when a transport operation is executed with respect to the medium P which is moved in the intersecting direction B in this manner, there is a tendency that the medium P which has moved in the intersecting direction B returns to the original position in the intersecting direction B.

According to the embodiment, when an ejecting operation is executed after executing a cutting operation, a transport operation is executed after executing the cutting operation and before executing the ejecting operation. For this reason, a transport operation is certainly executed after executing a cutting operation. Accordingly, it is possible to return the medium P to the original position even when the medium P moves in the intersecting direction B along with cutting of the medium P, and to suppress a landing failure of liquid which is associated with cutting of the medium P.

In the liquid ejecting apparatus 1 according to a second embodiment, in the first embodiment, the ejecting unit 6 can eject the liquid by being moved in the intersecting direction B which intersects the first direction A, and the transporting unit 10 can intermittently transport the medium P in the first direction A by each first distance L1, and the control unit 11 performs a control so that the ejecting unit 6 executes an ejecting operation of the liquid by moving the ejecting unit in the intersecting direction B, in a stop state of the medium P in the intermittent transport, and performs a control so that a transport distance of the medium P which is associated with the transport operation after executing of the cutting operation and before executing the ejecting operation is set to a distance L2 (L2*) which is shorter than the first distance L1.

According to the embodiment, it is possible to intermittently transport the medium P, and an ejecting operation of liquid is executed by moving the ejecting unit 6 in the intersecting direction B in a stop state of the medium P in the intermittent transport. In addition, a transport distance of the medium which is associated with the transport operation after executing of a cutting operation and before executing an ejecting operation is the distance L2 (L2*) which is shorter than the first distance L1. That is, it is possible to suppress a landing failure of liquid which is associated with cutting of the medium P by executing a micro transport of which a distance is the distance L2 (L2*), and to suppress a deviation in cutting position, even in a configuration in which it is not possible to move the medium P in the first direction A using the cutting unit 7 by setting the distance L2 (L2*) to the micro distance.

In the liquid ejecting apparatus 1 according to a third embodiment, in the second embodiment, the control unit 11 performs a control so that the ejecting operation and the cutting operation are executed in this order by changing the subsequent transport distance in the intermittent transport to the second distance L1* which is shorter than the first distance L1, when a stop position of the medium P after the subsequent transporting by the first distance L1 in the intermittent transport matches a cutting position of the medium P using the cutting unit 7, and performs a control so that a transport distance in the subsequent transport after transporting by the second distance L1* is set to the distance L2.

According to the embodiment, when the stop position of the medium P after the subsequent transporting by the first distance L1 in the intermittent transport matches the cutting position of the medium P using the cutting unit 7, the subsequent transport distance in the intermittent transport is changed to the second distance L1* which is shorter than the first distance L1. In addition, a transport distance in the subsequent transport after transporting by the second distance L1* is set to the second distance L2. That is, when a stop position of the medium P based on the intermittent transport matches the cutting position of the medium P, landing of liquid (liquid ejecting operation) is executed, and cutting of the medium P is executed by shifting a transport amount of the medium P in the intermittent transport before cutting, and transporting by the distance L2 is executed in the subsequent intermittent transport. For this reason, in a case in which a stop position of the medium P based on the intermittent transport matches a cutting position of the medium P, it is possible to suppress a landing failure of liquid which is associated with cutting of the medium P, and to suppress an occurrence of deviation in landing position of liquid which is associated with a change in transport amount in one intermittent transport.

In the liquid ejecting apparatus 1 according to a fourth embodiment, in the second embodiment, the control unit 11 performs a control so that the ejecting operation and the cutting operation are executed in this order after transporting by the distance L1, and a transport distance in the subsequent transport after transporting by the third distance L1** is set to the distance L2*, when the stop position of the medium P after the subsequent transporting by the first distance L1 in the intermittent transport does not match the cutting position of the medium P using the cutting unit 7, and the subsequent transport distance in the intermittent transport after transporting by the third distance L1** is set to the third distance L1** which is shorter than the first distance L1** in relation with the cutting position of the medium P.

According to the embodiment, when the stop position of the medium P after the subsequent transporting by the first distance L1 in the intermittent transport does not match the cutting position of the medium P using the cutting unit 7, and the subsequent transport distance in the intermittent transport after transporting by the third distance L1 is set to the third distance L1** which is shorter than the first distance L1 in relation with the cutting position of the medium P, the subsequent transport distance after transporting by the third distance L1** is set to the distance L2*. That is, when the stop position of the medium P based on the intermittent transport does not match the cutting position of the medium P, cutting of the medium P is executed after executing landing of liquid after transporting by the third distance L1**, and transporting by the distance L2*** is executed in the subsequent intermittent transport. For this reason, when the stop position of the medium P based on the intermittent transport does not match the cutting position of the medium P, it is possible to suppress a landing failure of liquid which is associated with cutting of the medium P, and to suppress an occurrence of deviation in landing position of liquid which is associated with a change in transport amount in one intermittent transport.

In the liquid ejecting apparatus 1 according to a fifth embodiment, in any one of the first to fourth embodiments, a transport distance of the medium P which is associated with the transport operation after executing of the cutting operation and before executing of the ejecting operation is set to be equal to or greater than 0.1 mm and equal to or smaller than 0.5 mm.

According to the embodiment, the transport distance of the medium P which is associated with the transport operation after executing of the cutting operation and before executing of the ejecting operation is equal to or greater than 0.1 mm and equal to or smaller than 0.5 mm. When the distances L2 and L2* are equal to or greater than 0.1 mm, it is a distance which is sufficient for returning the medium P which moved in the intersecting direction B to the original position in the intersecting direction B. At this time, when the distances L2 and L2* are equal to or smaller than 0.5 mm, the deviation in cutting position of the recording medium P falls within the allowable range as a printing matter.

In the liquid ejecting apparatus 1 according to a sixth embodiment, in any one of the first to fifth embodiments, a direction in which the medium P is transported in the transport operation after executing of the cutting operation, and before executing the ejecting operation includes the first direction A.

According to the embodiment, the direction in which the medium P is transported in the transport operation after executing the cutting operation, and before executing the ejecting operation includes the first direction A. For this reason, when executing the ejecting operation after executing the cutting operation, it is possible to suppress a landing failure of liquid which is associated with cutting of the medium P by executing a transport operation in the first direction A after executing the cutting operation and before executing the ejecting operation.

In the liquid ejecting apparatus 1 according to a seventh embodiment, in any one of the first to fifth embodiments, a direction in which the medium P is transported in the transport operation after executing of the cutting operation and before executing of the ejecting operation includes the second direction which is a direction opposite to the first direction A.

According to the embodiment, the direction in which the medium P is transported in the transport operation after executing of the cutting operation and before executing of the ejecting operation includes the second direction. For this reason, it is possible to suppress a landing failure of liquid which is associated with cutting of the medium P by executing a transport operation (reverse transport) in the second direction after executing the cutting operation, and before executing the ejecting operation, when the ejecting operation is executed after executing the cutting operation.

In the liquid ejecting apparatus 1 according to an eighth embodiment, in any one of the first to seventh embodiments, a transport distance of the medium P which is associated with the transport operation after executing of the cutting operation and before executing of the ejecting operation can be changed according to the width of the medium P.

According to the embodiment, the transport distance of the medium P which is associated with the transport operation after executing of the cutting operation and before executing of the ejecting operation can be changed according to the width of the medium P. For this reason, it is possible to set the transport distance of the medium P which is associated with the transport operation after executing of the cutting operation and before executing of the ejecting operation to an appropriate distance according to the width of the medium P.

In the liquid ejecting apparatus 1 according to a ninth embodiment, in the eighth embodiment, the transport distance of the medium P which is associated with the transport operation after executing of the cutting operation and before executing of the ejecting operation can be changed so as to be long when the width of the medium P is small, compared to a case in which the width of the medium P is large.

According to the embodiment, the transport distance of the medium P which is associated with the transport operation after executing of the cutting operation and before executing of the ejecting operation can be changed so as to be long when the width of the medium P is small, compared to a case in which the width of the medium P is large. Since the medium P remarkably moves in the intersecting direction B when being cut, in a case in which the width of the medium P is small compared to the case in which the width of the medium P is large, it is possible to set the transport distance of the medium P which is associated with the transport operation after executing of the cutting operation and before executing the ejecting operation to an appropriate distance.

In the liquid ejecting apparatus 1 according to a tenth embodiment, in the first embodiment, the ejecting unit 6 can eject liquid by being moved in the intersecting direction B which intersects the first direction A, the transporting unit 10 can intermittently transport the medium P in the first direction A by each first distance L1, and the control unit 11 performs a control so that an ejecting operation of the liquid is executed by moving the ejecting unit 6 in the intersecting direction B in a stop state of the medium P in the intermittent transport, and performs a control so that the ejecting operation is executed before executing the cutting operation, when a stop position of the medium P after the subsequent transport by the first distance L1 in the intermittent transport matches the cutting position of the medium P using the cutting unit 7.

According to the embodiment, it is possible to intermittently transport the medium P, and an ejecting operation of liquid is executed by moving the ejecting unit 6 in the intersecting direction B in a stop position of the medium P in the intermittent transport. In addition, when the stop position of the medium P after the subsequent transporting by the first distance L1 in the intermittent transport matches the cutting position of the medium P using the cutting unit 7, the ejecting operation is executed before executing the cutting operation. That is, when the stop position of the medium P based on the intermittent transport matches the cutting position of the medium P, it is possible to prevent the ejecting operation of liquid from being executed without executing the transport operation after executing the cutting operation of the medium P, when the ejecting operation of liquid is executed before executing the cutting operation of the medium P. That is, the transport operation of the medium P is executed after executing the cutting operation of the medium P, and before executing the ejecting operation of liquid. Accordingly, it is possible to suppress a landing failure of liquid which is associated with cutting of the medium P.

A liquid ejecting method according to an eleventh embodiment which can be executed using the liquid ejecting apparatus 1 includes the transporting unit 10 of the medium P, the ejecting unit 6 which can eject liquid onto the medium P, and the cutting unit 7 of the medium P which is provided on the downstream side compared to the ejecting unit 6 in the first direction A in directions in which the medium P is transported using the transporting unit 10, in which a transport operation of the medium P using the transporting unit 10 is executed after executing a cutting operation, and before executing an ejecting operation of the liquid, when the ejecting operation of the liquid using the ejecting unit 6 is executed after executing the cutting operation of the medium P using the cutting unit 7.

According to the embodiment, the transport operation is executed after executing the cutting operation, and before executing the ejecting operation, when the ejecting operation is executed after executing the cutting operation. For this reason, the transport operation is certainly executed after executing the cutting operation. Accordingly, it is possible to return the medium P which moved to the original position even when the medium moves in the intersecting direction B along with the cutting of the medium P, and to suppress a landing failure of liquid which is associated with cutting of the medium P.

The entire disclosure of Japanese Patent Application No. 2014-209990, filed Oct. 14, 2014 is expressly incorporated reference herein.

What is claimed is:

1. A liquid ejecting apparatus comprising:

a conveyor configured to transport a medium along a conveyance direction;

a liquid ejector configured to eject liquid onto the medium to create an image on the medium;

a cutter located downstream from the liquid ejector in the conveyance direction, the cutter being configured to cut the medium; and a controller configured to execute the following operations:

a first ejecting operation that ejects the liquid onto the medium using the liquid ejector to complete a first part of the image;

a first conveyance operation that follows the first ejecting operation and that, using the conveyer, conveys the medium a first distance along the conveyance direction when the medium is not to be cut prior to a second ejection operation in sequence, wherein the second ejecting operation follows the first conveyance operation and ejects the liquid onto the medium using the liquid ejector to complete a second part of the image that builds on the first part of the image;

a second conveyance operation that follows the second ejecting operation and that using the conveyer, conveys the medium a second distance, different from the first distance, along the conveyance direction;

a cutting operation that follows the second conveyance operation and that cuts the medium using the cutter;

a third conveyance operation that follows the cutting operation and that, using the conveyer, conveys the medium a third distance, different from the first distance, along the conveyance direction; and a third ejecting that follows the third conveyance operation and that ejects the liquid onto the medium using the liquid ejector to complete a third part of the image that builds on the second part of the image;

wherein the sum of the second distance and the third distance are substantially equal to the first distance.

2. The liquid ejecting apparatus according to claim 1, wherein the third distance of the medium in the third conveyance operation is set to be equal to or greater than 0.1 mm and equal to or smaller than 0.5 mm.

3. The liquid ejecting apparatus according to claim 1, wherein a transport distance of the medium in the third conveyance operation is changed based on a length of the medium in a width direction intersecting the conveyance direction.

4. The liquid ejecting apparatus according to claim 3, wherein the controller sets a transport distance of the medium in the third conveyance operation in a case in which the length of the medium in the width direction is a first length to be longer than a transport distance of the medium in the third conveyance operation in a case in which the length of the medium in the width direction is a second length which is longer than the first length.

5. A liquid ejecting method executed by a liquid ejecting apparatus that includes a conveyor configured to transport a medium in a conveyance direction; a liquid ejector configured to eject liquid onto the medium to create an image on the medium; a cutter located downstream from the liquid ejector in the conveyance direction, the cutter being configured to cut the medium, the method comprising:

executing a first ejecting operation in which the liquid is ejected onto the medium using the liquid ejector to complete a first part of the image;

executing a first conveyance operation, using the conveyer, in which the medium is conveyed a first distance along the conveyance direction following the first ejecting operation when no cutting operation is to follow the first ejecting operation in prior to a second ejection operation sequence;

executing the second ejecting operation following the first conveyance operation to complete a second part of the image that builds on the first part of the image;

executing a second conveyance operation in which the medium is conveyed a second distance, different from the first distance, along the conveyance direction following the second ejecting operation;

executing the cutting operation in which the medium is cut using the cutter prior to completion of the image on the medium and following the second conveyance operation;

executing a third conveyance operation in which the medium is conveyed a third distance, different from the first distance, along the conveyance direction following the cutting operation in which the medium is cut using the cutter; and executing a third ejecting operation following the third conveyance operation to complete a third part of the image that builds on the second part of the image;

wherein the sum of the second distance and the third distance are substantially equal to the first distance.

6. The liquid ejecting apparatus according to claim 1, wherein the second distance is smaller than the first distance.

7. The liquid ejecting apparatus according to claim 1, wherein:

the first distance is defined by the liquid ejector's capacity for liquid ejection in the conveyance direction during the first ejecting operation.

8. The liquid ejecting apparatus according to claim 1, wherein the liquid ejector's capacity for liquid ejection in the conveyance direction during the first ejecting operation defines an ejecting width;

the first distance is fixed to be substantially equal to the ejecting width;

the second distance is smaller than the first distance; and the third distance is the first distance less the second distance.

9. The liquid ejecting apparatus according to claim 1, wherein the controller is an electronic data processor.

10. The liquid ejecting apparatus according to claim 1, wherein the cutting operation cuts the medium prior to completion of the image on the medium.

11. The liquid ejecting apparatus according to claim 1, wherein all medium conveyance operations convey the medium in the same direction.

12. The liquid ejecting apparatus according to claim 1, wherein:

the liquid ejector is limited to completing a linear segment, in a direction intersecting the conveyance direction, of the image during each ejection operation, the linear segment having a length along the direction intersecting the conveyance direction and a width along the conveyance direction, the width of the linear image segment being defined by a liquid ejection capacity of the liquid ejector in the conveyance direction during an ejection operation;

a plurality of said linear segments build upon each other to create the image on the medium;

each of said first part of the image, second part of the image, and third part of the image is separate one of said plurality of linear segments; and the first distance is set to the width of the linear image segment.

13. The liquid ejecting apparatus according to claim 1, wherein:

the second conveyance operation is a most recent conveyance operation immediately preceding the cutting operation; and the third conveyance operation is a most recent conveyance operation immediately following the cutting operation.

14. The method of claim 5, wherein:

the second ejecting operation ejects the liquid onto the medium using the liquid ejector;

the second conveyance operation uses the conveyer to convey the medium;

the third conveyance operation uses the conveyer to convey the medium; and the third ejecting operation ejects the liquid onto the medium using the liquid ejector.

15. The method of claim 5, wherein the first distance is defined by the liquid ejector's capacity for liquid ejection in the conveyance direction during execution of the first ejecting operation.

16. The method of claim 5, wherein:

the liquid ejector is limited to completing a linear segment, in a direction intersecting the conveyance direction, of the image during each ejection operation, the linear segment having a length along the direction intersecting the conveyance direction and a width along the conveyance direction, the width of the linear image segment being defined by a liquid ejection capacity of the liquid ejector in the conveyance direction during an ejection operation;

a plurality of said linear segments build upon each other to create the image on the medium;

each of said first part of the image, second part of the image, and third part of the image is separate one of said plurality of linear segments; and the first distance is set to the width of the linear image segment.

17. The method of claim 5, wherein all medium conveyance operations convey the medium in the same direction.

18. The method of claim 5, wherein:

the second conveyance operation is a most recent conveyance operation immediately preceding the cutting operation; and the third conveyance operation is a most recent conveyance operation immediately following the cutting operation.

* * * * *